US007232243B1

(12) United States Patent
Nassif

(10) Patent No.: US 7,232,243 B1
(45) Date of Patent: Jun. 19, 2007

(54) SPORTING APPARATUS

(76) Inventor: Claude L. Nassif, 8101 Westlawn Ave., Los Angeles, CA (US) 90045

( * ) Notice: Subject to any disclaimer, the term of this patent is extended or adjusted under 35 U.S.C. 154(b) by 0 days.

(21) Appl. No.: 11/072,208

(22) Filed: Mar. 4, 2005

Related U.S. Application Data

(60) Provisional application No. 60/551,622, filed on Mar. 8, 2004.

(51) Int. Cl.
*F21W 101/00* (2006.01)

(52) U.S. Cl. ..... 362/459; 362/249; 362/464

(58) Field of Classification Search ..... 362/84, 362/802, 249, 252, 800, 806, 464, 459
See application file for complete search history.

(56) References Cited

U.S. PATENT DOCUMENTS

| | | | | |
|---|---|---|---|---|
| 4,011,575 | A | 3/1977 | Groves | |
| 4,382,274 | A | 5/1983 | De Backer et al. | |
| 4,991,066 | A * | 2/1991 | McCowan | 362/464 |
| 4,997,196 | A * | 3/1991 | Wood | 280/87.042 |
| 5,130,906 | A | 7/1992 | Lund | |
| 5,746,499 | A | 5/1998 | Ratcliffe et al. | |
| 6,020,818 | A | 2/2000 | Chittenden | |
| 6,086,213 | A | 7/2000 | Holce | |
| 6,104,140 | A | 8/2000 | Wut et al. | |
| 6,110,574 | A | 8/2000 | Ochi et al. | |
| 6,354,714 | B1 | 3/2002 | Rhodes | |
| 6,431,733 | B2 * | 8/2002 | Seifert et al. | 362/459 |
| 6,540,384 | B1 | 4/2003 | Rosevear | |
| 6,621,419 | B2 * | 9/2003 | Chiu | 340/815.42 |
| 6,646,547 | B2 * | 11/2003 | Chiu | 340/321 |
| 6,802,636 | B1 * | 10/2004 | Bailey, Jr. | 362/555 |
| 2004/0257831 | A1 * | 12/2004 | Liao | |

OTHER PUBLICATIONS

Web Pages From "www.snowboarding.com": Six Pages "Board Anatomy", Board Definitions; "Snow Boards Vary Widely in Terms of Quality and Construction".
web Pages from "www.theboarderline.com": Two Pages "Anatomy of a Snowboard: A Look at What Makes up a Snowboard".

* cited by examiner

*Primary Examiner*—Laura K. Tso

(57) ABSTRACT

The present disclosure is directed to sporting apparatus comprising at least one elongated member having top, bottom and edge surfaces and at least a portion of at least one light source assembly embedded flush or substantially flush or recessed relative to at least one of the surfaces. In particular embodiments, the apparatus can include, but is not limited to, a snowboard, at least one ski or skate. An exemplary light source can include, but is not limited to, at least one embedded light emitting diode.

14 Claims, 4 Drawing Sheets

FIG. 3
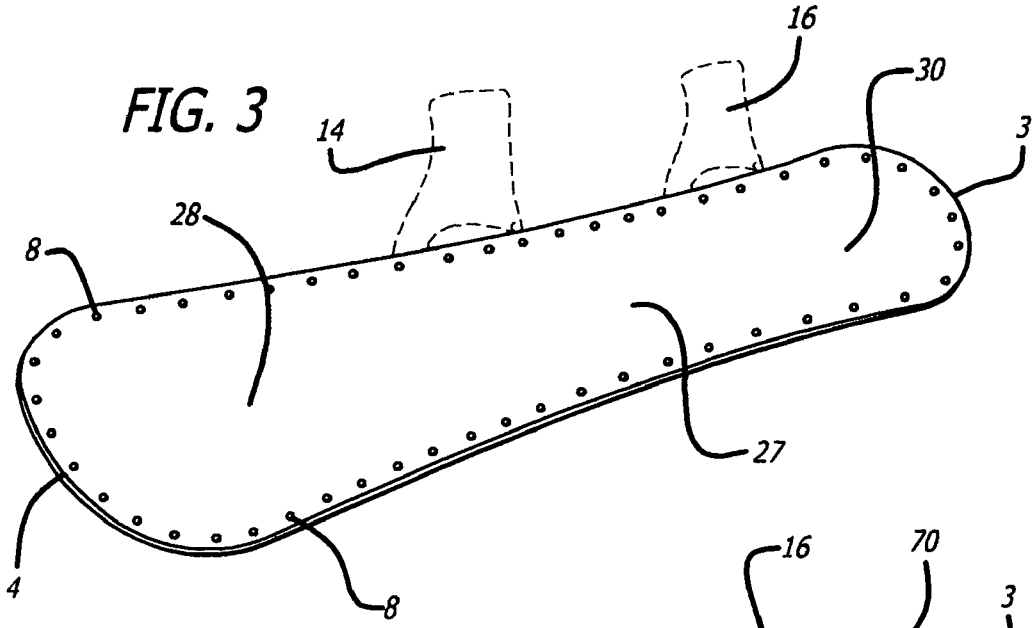
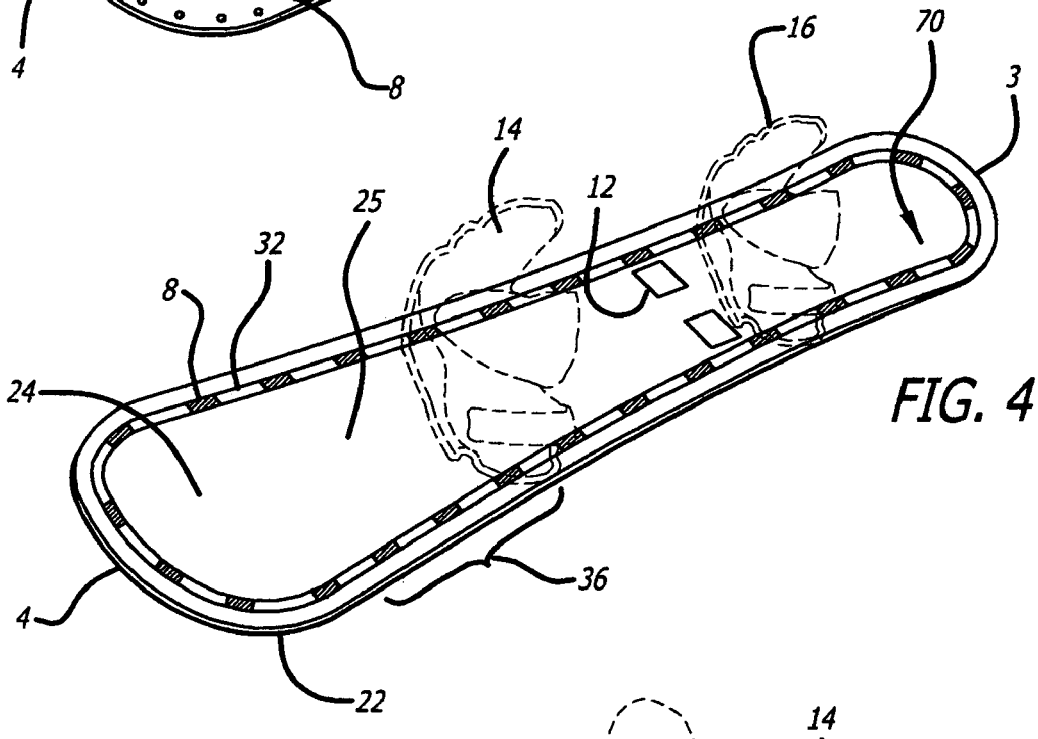
FIG. 4
FIG. 5
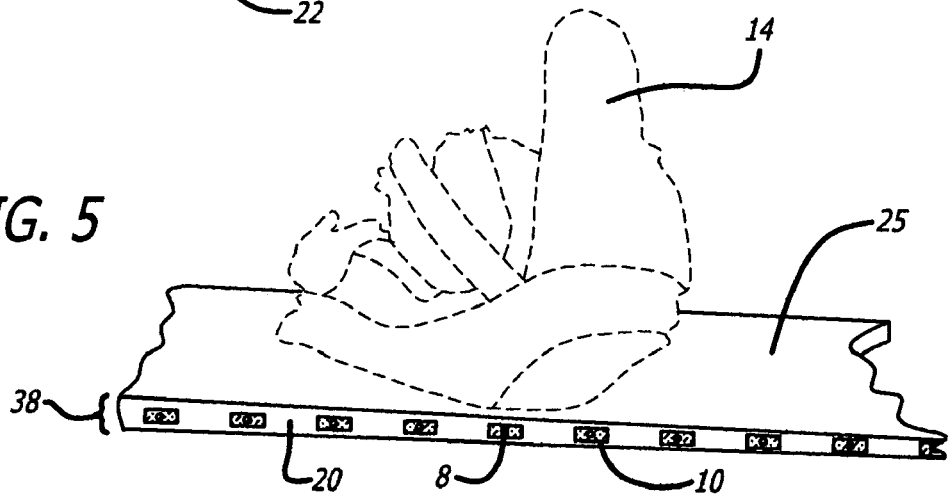

SPORTING APPARATUS

CROSS-REFERENCE TO RELATED APPLICATIONS

This application is related to and claims benefit and priority of U.S. Provisional Application No. 60/551,622, filed Mar. 8, 2004, herein incorporated by reference in its entirety.

FIELD

This disclosure relates generally to the field of sporting equipment/apparatus and light elements, and more particularly to sporting equipment/apparatus having at least one embedded light. Even more particularly the disclosure relates to light source assemblies and/or components thereof that are flush and/or substantially flush with a surface of the sporting equipment.

BACKGROUND

Improvements in various aspects of sporting equipment have been undertaken, such as increasing a sporting participant's visibility and safety, as well as easing the retrieval of equipment that may, in the course of a user's participation in a sport, become separated from the user. Being able to see and make visible sporting participants is essential in maintaining a safe and accident free environment, particularly when the sport activity is taking place in environments or situations when visibility is less than ideal. An example of such sporting equipment is includes snowboards. Snowboards have been a variation of snow skis for approximately the last fifteen years. The sport combines the skills of surfing with the skills of skiing and has become very popular in recent years.

A snowboard is generally a singular flat/substantially flat board with upwardly sloping tips at front and rear portions. The width of the board and the curve of the tips can vary. Typically, a user clamps boots into bindings that are firmly attached to the board so that the user is standing in a sideways/substantially sideways position with respect to the board, similar to the stance of a skate boarder or surfer to their skateboard or surfboard, respectively. There are variations for positioning a rider's feet, as known in the snowboarding art, such as bindings/mountings that vary in position from one another and even bindings that place a rider's feet parallel/substantially parallel to an axis substantially defined by the tips of the snowboard.

When snowboarding under adverse conditions such as dusk or night time or during a period of fog or snow, a person can find it difficult to see very far in front of the board and/or to be seen by others, thus increasing the risk of the person becoming injured by others and/or injuring themselves. In these situations it would be beneficial to have lighted sporting equipment that could help the user see ahead more clearly and/or make it easier for others to see the user.

Attempts to accomplish such results typically have included mounting a large, unwieldy and unsightly lamp, analogous to a headlamp utilized in various motor vehicles, in order to try and improve the visibility of/for the user. For example, see U.S. Pat. No. 6,540,384.

Previously, various lighting assemblies and insets have been provided for various purposes. For example, an assembly is provided in U.S. Pat. No. 4,382,274 to De Backer et al, which is for airport runway guidance light apparatus. An embedded LED (light emitting diode) lighting system is taught in U.S. Pat. No. 6,354,714 to Rhodes. This patent provides a lighting system for marking flooring, walkways, roadways and airport runways. U.S. Pat. No. 5,130,906 to Lund teaches of a flush mounted visor light that is countersunk or flush mounted with an edge of a visor that is typically found on trucks. U.S. Pat. No. 4,011,575 to Groves discloses an LED array having a plurality of electrical conductive paths for each LED in the array. U.S. Pat. No. 6,086,213 to Holce teaches a universal illuminating mount assembly for wearing to enhance visibility, recognition and safety of a user.

U.S. Pat. No. 6,110,574 to Ochi, et al. teaches a retroreflective sheeting that is resistant to freezing and resists snow from sticking to the surface of the sheeting.

U.S. Pat. Nos. 5,746,499 and 6,104,140 to Ratcliffe et al. and Wut et al., respectively, teach of footwear having pulsed and motion activated illumination systems.

One of the main pressures that play a large role in the choosing of sporting equipment, particularly winter sporting equipment, is the impression or overall attractiveness of the equipment, as well as the practicality of the equipment. Senses of style and impression play a big role on the slopes, and bulky contraptions, as exemplified by the headlight of U.S. Pat. No. 6,540,384, are unlikely to be utilized by the public at large, particularly active young. This is because such configurations are large and obtrusive and may indeed interfere with the utility of the sporting equipment, thereby interfering with the balance and performance of the snowboard, not too mention not being aesthetically pleasing.

SUMMARY OF THE DISCLOSURE

An exemplary object of the disclosure, according to the teachings disclosed herein, is to provide a sporting apparatus comprising at least one elongated member and at least one light source assembly having a light source, such as, for example, a light emitting diode or other light emitting element, which is embedded in the sporting apparatus. Exemplary sporting apparatus having at least one elongated member include a ski, skate or a snowboard and the like.

Another object, according to teachings and exemplary embodiments disclosed herein, include a light source assembly embedded in the at least one elongated member such that the light source assembly is flush/substantially flush with an area of the at least one elongated member, such as a top, bottom, side and edge areas, or any combination thereof.

The light source assembly can comprises a light source and associated housing, configured to be embedded in the at least elongated member such that the light source assembly is substantially flush with a surface area or areas of the at least one elongated member. In still other embodiments, at least one light source and associated components comprising the light source assembly is provided underneath/encased in the sporting apparatus that is below uppermost and/or bottommost surface of the sporting apparatus. In still other embodiments, the at least one light source and associated components are below/substantially below a surface portion of the sporting apparatus, and may either have above them a clear and/or opaque element, such that at least a portion of light to be emitted from the at least one light source of the light source assembly and associated components passes through the clear and/or opaque element.

It is still yet another object to provide a sporting apparatus comprising at least one embedded light source assembly that is shock-resistant and waterproof and/or water resistant.

In exemplary embodiments, the light source assembly utilizes at least one light emitting diode as a light source. In other embodiments, the light source further comprises at least one light-emitting filament. Additional embodiments have at least one light source assembly which is embedded into the sporting apparatus such that at least a portion of the at least one light source assembly is flush with an area of said at least one elongated member. In still other embodiments, the at least one light source assembly is encapsulated so as to protect it from moisture and other detrimental elements and conditions. Another object is to provide encapsulation and/or covering on at least one side of or one portion of the at least one elongated member of the sporting apparatus. In other embodiments, the at least one light source assembly is covered by a cover portion that may be colored, opaque or clear/substantially clear, or when a plurality of light source assemblies are provided, covering portions may be provided having any combination of the aforementioned covering characteristics.

It is still another object, according to the teachings of the present disclosure, to provide sporting apparatus having at least one light source assembly, with at least one reflective element mounted upon or in the sporting apparatus, such that light emitted from the at least one light source assembly is reflected by the at least one reflective element.

In yet another embodiment, the present disclosure teaches sport apparatus comprising electroluminescent portions. Such portions become luminous when the electroluminescent portions have a current passed therethrough, thus emitting light.

It is still a further object, according to the teachings of the present disclosure, to provide the embedded light source assembly with a least one light conducting assembly for conducting light provided by said light source. In particular embodiments, said light conducting assembly comprises fiber optic fibers/cables. In particular embodiments, the embedded light source is in communication with a trigger/switch means, for turning the at least one light source assembly on and off or to activate pulsed lighting that can be motion and/or pressure activated. In some embodiments such a trigger can be actuated by electromagnetic waves such as, but not limited to, visible electromagnetic waves, infrared waves, near-infrared waves, radio waves, microwaves and UV waves.

In one embodiment provided by the disclosure, the sporting apparatus is comprised of at least one light strip, the light strip being comprised of at least one light source assembly. In particular embodiments, the light strip has in addition non-illuminating portions. In other embodiments, the light strip is further comprised of at least one fiber optic component.

In another aspect the at least one light strip is comprised of at least one light emitting diode and associated elements. These components are provided such that they are at least partially encased in a barrier material that provides protection, typically from damage and moisture.

Another object of the disclosure provides methods for providing sports equipment/apparatus having embedded light source assemblies in accordance with the teachings presented herein.

Other objects and advantages of the present disclosure will become apparent from the following descriptions, taken in connection with the accompanying drawings. It should be clear that the present disclosure is in no way limited to embodiments shown in the drawings.

The drawings constitute a part of this specification and include exemplary depictions according to the disclosure, which may be embodied in various forms. It is to be understood that in some instances various aspects may be shown exaggerated or enlarged to facilitate an understanding of the disclosure.

BRIEF DESCRIPTION OF THE DRAWINGS

FIG. 3 is a bottom view of the exemplary embodiment of FIG. 2;

FIG. 4 is a perspective view of another exemplary embodiment;

FIG. 5 depicts an edge portion of an exemplary embodiment;

DETAILED DESCRIPTION

Detailed descriptions are provided herein. It is to be understood, however, that embodiments disclosed the present disclosure may be embodied in various forms. Therefore, specific details disclosed herein are not to be interpreted as limiting, but rather as a representative basis for teaching one skilled in the art to employ the teachings of the present disclosure in virtually any appropriately detailed system, structure or manner.

Figure 1:
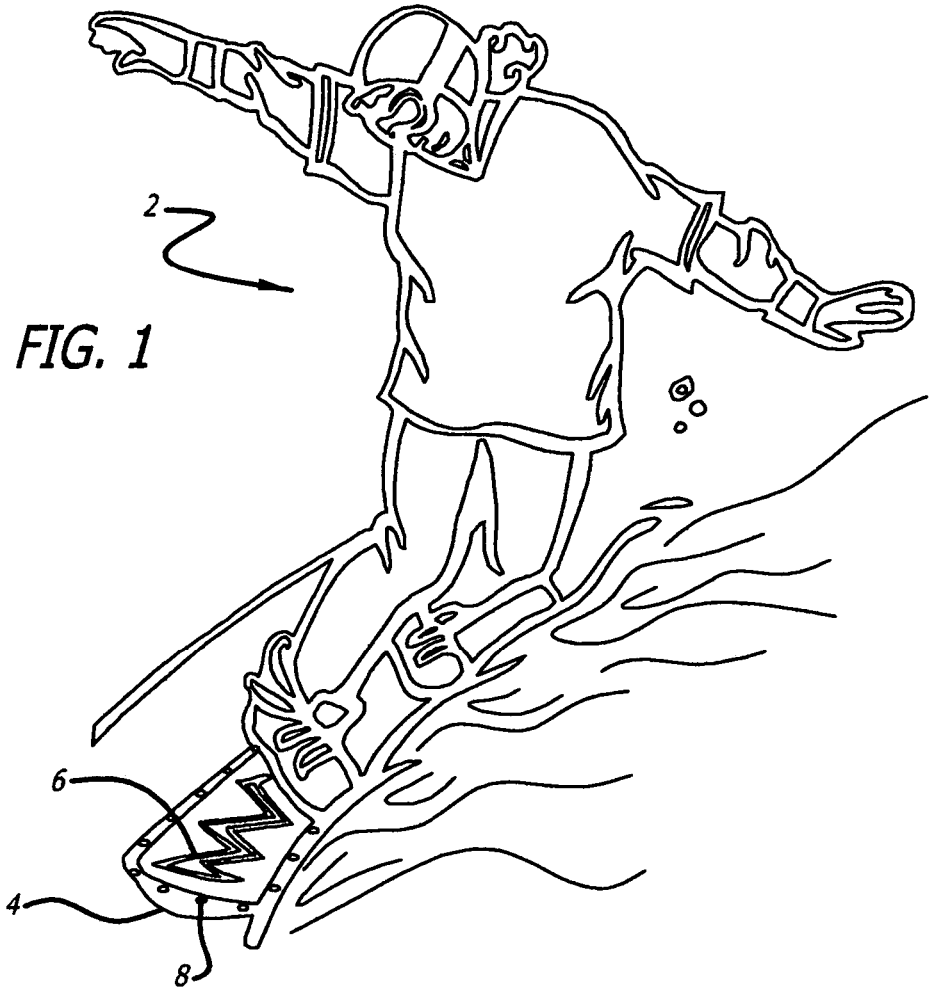
FIG. 1 is an exemplary illustration of a sport participant upon an embodiment in accordance with an aspect of the disclosure.
Figure 2:
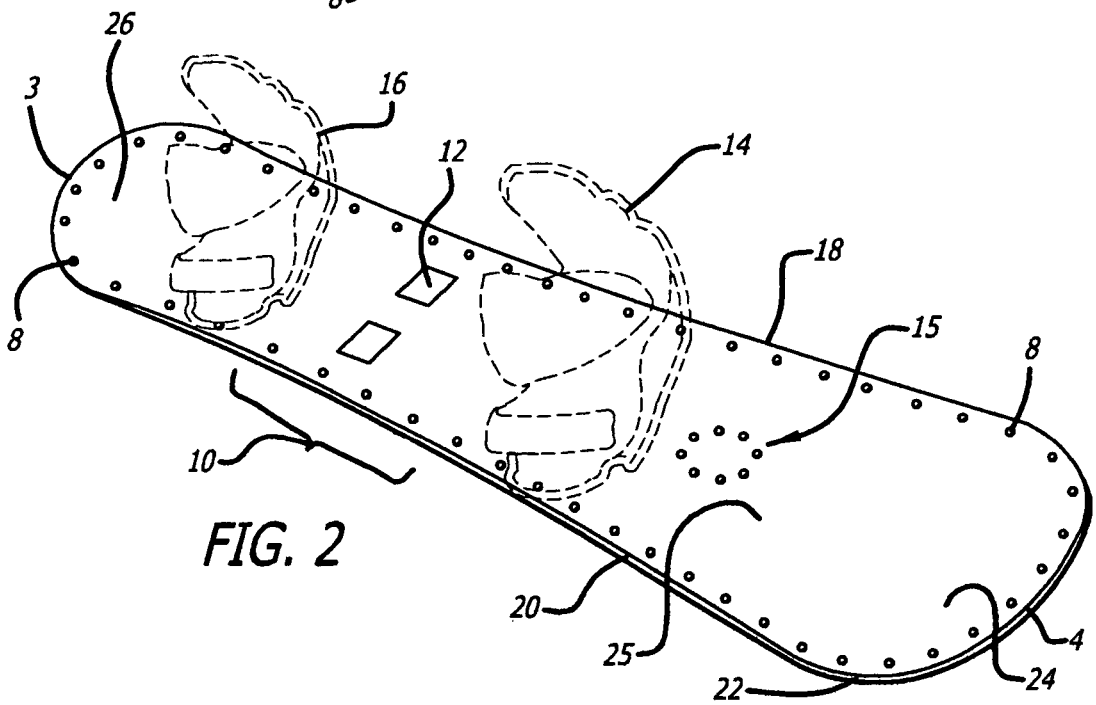
FIG. 2 is a perspective view of an exemplary embodiment of a sporting apparatus.

Referring generally to FIGS. 1 and 2, a first preferred embodiment of a sporting apparatus, here exemplarily presented as a snowboard, is provided in accordance with the principles of the present disclosure. The sporting apparatus may be comprised of any of a variety of suitable materials, such as metals, fiberglass, polymers or composites, as known in the art. Construction particulars are well known to those in the art. An exemplary description of snowboard construction may be found at http://www.grafsnowboards.com/matidx.htm, herein incorporated by reference, as well many other websites and texts that are readily available to those of ordinary skill in the art of sport equipment/apparatus manufacturing and design.

Regarding the snowboard embodiment, typical snowboard construction typically falls into three categories: Sidewall (sandwich) construction, cap construction, and hybrid (half-cap) construction. Sidewall and cap constructed boards are the two most popular types of boards, are both useful for practicing the teachings of the present disclosure, as well as snowboards having hybrid constructions.

A topsheet (outer skin) on a cap board extends to the edges, while on a sandwich board the topsheet is flat, with armor plating on the sides provided by separate sidewalls.

One of the most important parts of a snowboard is the core material, which can be made of wood, foam, honeycomb panels, or a combination of wood and other composite materials for example. All core material, as well as other components, are easily amenable to appropriate formation to contain the various light source assembly or assemblies, races/channels for providing conduits and related electrical/circuit components that are taught by the present disclosure. Such formation may be provided by cutting or otherwise forming appropriate channels/grooves, apertures/orifices and compartments and the like from blank formed components, or the various components may by manufactured having the appropriate channels/grooves, apertures/orifices and compartments.

A snowboard typically comprises, from the bottom up, a plastic base, typically made of a polymer material, such as, but not limited to polyethylene (p-tex). There are basically three different types of snowboard bases, extruded, sintered, and graphite, all of which may be utilized in accordance with the teachings of the present disclosure.

Snowboards have metal edges and are typically provided in one of two configurations, partial steel edges that run only along the sides of the board, ending at the nose and tail of the snowboard, and edges that wrap all the way around both ends of the board. Metal edges serve many functions, such as protecting the board from damage, help the board grip the snow, and gives control in your turns. The teachings of the present disclosure can be utilized by any snowboard, whether having a four piece edge, or a two piece edge. Some snowboard producers fully wrap their boards with the metal edge, while other producers partially wrap snowboards boards with the steel edge (leaving the metal edge off of the tip and tail of the board). The metal edges may also serve to protect the embedded light source assemblies, particularly if embedded light source assemblies are mounted so as to project light out the sides/edges of the snowboard.

Fiberglass or epoxy is then disposed upon the wood or foam core, more glass or epoxy and steel inserts to attach the bindings. Typically, snowboards have a camber to them. That is, the gentle arch a board makes when rested on a flat surface. Camber is related to flex: the higher the camber, the more pressure the board exerts at the nose and tail.

Fiberglass is the major structural component of typical snowboards currently in use. Different weaves and placements of fiberglass within a board can influence its flex pattern, strength and weight. Typically, boards contain "unidirectional" glass fabric (with most of the fibers running the length of the board). Torsionally stiff boards use additional layers with the fibers running diagonally. Any layer may be reinforced with carbon fiber or Kevlar, which can help reduce the board's weight while improving its strength. This fiberglass can be used to embed and/or help to keep in place the light source elements, or portions thereof, that are at least partially embedded into appropriated/desired recesses provided by the correspondingly shaped core, as well as other snowboard components.

In particular embodiments, where metal layers are used (in some high-speed and extreme boards for extra stability and strength, which can be aluminum alloy and/or steel, such as, but not limited to, stainless steel), support structures of the light source assemblies may be provided in rigid communication therewith. As an example, the various bus elements and/or housing elements of an LED array, for example, may be welded or epoxied to the metal layers. Furthermore, such metal layers may provide a path of conduction for providing a requisite electric current to a plurality of light source assemblies located at various positions of the snowboard, from a power supply, for example.

A topsheet provides the top of the snowboard. The topsheet protects the insides of the snowboard from damage and exposure to ultra-violet rays. The material used for the topsheet can vary, but there are basically two types of topsheets. There are glossy and matte topsheets. Again, when portions of the light source assembly projects above the topsheet of the snow board, the topsheet may be configured with openings that correspond to the at least one light source assembly that projects above the top surface of the snowboard and/or is substantially flush with same.

In accordance with the teachings of the present disclosure, the various snowboard components, such as the core, fiberglass and topsheet, are configured in order to allow recessed areas wherein at least a portion of the light source assembly may be embedded. As shown in various embodiment, FIGS. 1, 2, 7 and 8, light source assemblies 8 are mounted so as to be substantially flush with an edge 20, and/or surface of the snowboard Turning to FIG. 1, an exemplary illustration of a sport participant 2 upon an embodiment of the disclosure is provided. In this example, sport participant 2 is a snowboarder and is riding a sporting apparatus 7 having an electroluminescent element 6, here provided exemplarily in a zigzag pattern. Retroreflective sheeting may also be utilized and disposed upon any surface of sporting apparatus 7 disclosed herein in any desired pattern/configuration. Exemplary useful retroreflective sheeting is discussed in U.S. Pat. No. 6,110,574, herein incorporated by reference in its entirety. In one embodiment, sporting apparatus 7 also includes at least one light source assembly 8, here located substantially at a top, front periphery portion of sporting apparatus 7, such as a front portion 4.

FIG. 2 depicts another embodiment provided in accordance with the teachings of the present disclosure, here shown from a top perspective view. Various elements are depicted. As described previously, the sporting apparatus has a front portion 4, often referred to as a tip or nose, and a rear portion 3, often referred to as the tail. There also includes a front top portion 24, which is generally the top portion forward first binding 14, and a rear top portion 26, which is generally the top portion to the rear of second binding 16. A top middle portion 11 is generally the top portion located generally between first binding 14 and second binding 16. Top surface 25 is utilized herein to generally describe the top surface of sporting apparatus 7.

Additional portions include circumferential portions 22 at both ends of sporting apparatus 7 that are generally located between front portion 4/rear portion 3 and edges 18/20. Sporting apparatus 7 also includes edges 18 and 20 which run along the perimeter of sporting apparatus 7. Additionally and in this embodiment, a plurality of light source assemblies 10, which may be referred to as an array of light source assemblies, is provided, comprised of light source assembly 8. Plurality of light source assemblies 10 may be comprised of at least two light source assemblies 8. As an example, light source assemblies 10 in FIG. 2 encompasses four light source assemblies 8 along the periphery of sport apparatus 7, but by no means is plurality of light source assemblies 10 thus limited, as plurality of light source assemblies 10 may encompass any plurality of light source assemblies 8 as may be desired, that is from as few as two light source assemblies to as many as tens, hundreds or even thousands of light source assemblies, as may be desired, for example.

A plurality of light sources assemblies 10 in FIG. 2 are disposed along/substantially along the periphery of sporting apparatus 7. As shown, light source assemblies 8 may be provided in any useful/desired configuration, including portion of sporting apparatus 7 that are not along/substantially along the periphery of sporting apparatus 7. As an example, a plurality of light source assemblies 10 may be provided in a circular configuration 15 upon/in top surface 25 just in front of first binding 14. Additionally, other configuration can be provided such that a sporting participant 2 has emitted light directed upon him/herself and can thus be illuminated by at least one light source assembly 8 provided as part of sporting apparatus 7. This configuration is particularly useful in order to help better identify the location of sporting participant 2 under less than ideal visibility conditions, such as during snowfall and/or fog, for example.

Top middle portion 11 may host a variety of components and circuitry associated with light source assembly 8, that are part of the sporting apparatus 7 disclosed herein. As an example, battery/power supply 12 may be provided in such an area, such that any associated weight is thus optimally located. Any appropriate type of battery/power source may be utilized, such as alkaline, rechargeable, lithium batteries and other suitable power supplies. Additionally, a switch 15 for controlling current flow from battery/power supply 12 to light source assemblies is also provided. Switch may be of any suitable configuration or type, such a push-button, plunger, toggle, slide, etc. . . . as known in the art.

FIG. 3 depicts a bottom view of an exemplary embodiment in accordance with the present disclosure. Depicted therein is, generally, bottom surface 27, front bottom surface 28 and rear bottom surface 30. As shown, bottom surface 27 in one embodiment is provided with appropriate apertures/orifices and is configured to provide for embedding and mounting of a plurality of light source assemblies 10 comprised of many light source assemblies 8. As shown, individual light source assemblies 8 may be mounted peripherally along bottom surface 27 of sporting apparatus 7, similar to the exemplary configuration detailed in FIG. 1.

Another alternative embodiment is depicted in FIG. 4. Here, light source assemblies 8 are provided as part of a ribbon-type assembly of lights 70, which can comprise unlit portions 32, that is, portions that do not emit light. Ribbon-type assembly of lights 70 are similar to illumination systems typically found along aisles in movie theaters and along the aisles of airline cabins. Owing to their construction and durability, ribbon-type assembly of lights 70 can be embedded into sporting apparatus 7 at any location of top surface 25, bottom surface 27 and edges 18 and 20, or any combination thereof. A section of the plurality of light source assemblies is indicated by reference numeral 36. A integrally formed linear light strip with light emitting diodes that is useful in accordance with the teachings disclosed herein is described in U.S. Pat. No. 5,927,845, herein incorporated by reference in its entirety.

It is also further contemplated that fiber optic fibers/cables may also be utilized to provide illumination substantially emanating from a surface of the sporting apparatus 7. That is, the fiber optic fibers/cables will emerge from an appropriate light source (e.g. LED/bulb, etc) and can run along sporting apparatus 7 either exposed or underneath a surface of the sporting apparatus. At desired points, sporting apparatus 7 comprises appropriate apertures, for example in top surface 4 and/or bottom surface 3, and/or edges 18/20 and/or circumferential portions 22, where a portion of the fiber optic fibers/cables may be exposed and thus emanate light, such as a tip portion of a fiber optic fibers/cables. Such a configuration can provide for lit up indicia or may provide a glittering/sparking-type of presentation, similar to an artistic rendering of star upon a dark background, for example. Use of fiber optic fibers/cables to provide sporting apparatus 7 with illumination indicia may thus be provided.

Figure 6:
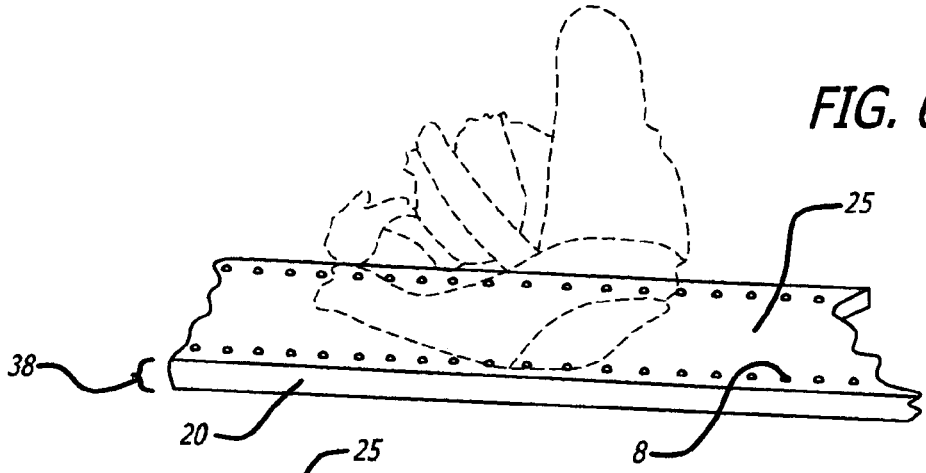
FIG. 6 depicts an edge and top surface portion of an exemplary embodiment.

In addition to embedding of light source assemblies 8 at locations of top surface 25 and bottom surface 27, light source assemblies 8 may also be embedded at edge portions 18 and 20, which run the perimeter of sporting apparatus 7. As shown in FIG. 5, exemplary edge 20 has a thickness 38, typically, as an example, in the range of about 0.25 cm to about 4 cm, more preferably from about 0.33 cm to about 2.5 cm and even more preferably from about 0.5 cm to 1 cm. Embedded therein at edge 20 is at least one light source assembly 8, preferably a plurality of same. Light source assemblies 8 may be provided at an edge portion such as edge 20, along the whole or part of the periphery of sporting apparatus 7, and may be provided at only an edge portion, only a top surface 25 portion or only a bottom surface portion 27, or any combination thereof. As shown in FIG. 6, a plurality of light assemblies 8 may be embedded at a top surface 25 and an edge, here exemplarily indicated as edge 20.

Figure 7:
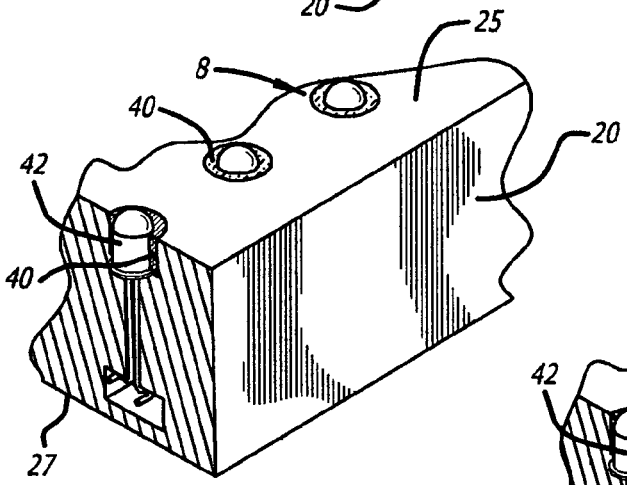
FIG. 7 depicts exemplary components of an exemplary light source assembly in accordance with one aspect of the present disclosure.

An up close sectional view of an exemplary configuration of an embodiment provided in accordance with the present disclosure, FIG. 7 shows light source assembly 8 embedded substantially flush with top surface 25 and adjacent to edge 20. In this embodiment, light source assembly is comprised of a light emitting diode (LED) 42, having a head or bulb, lens . . . etc encased in a support medium 40 such as clear or colored polymer/plastic material utilized for LED bulb manufacturing or more preferably pliable, resilient rubber or plastic material, such as but not limited to, appropriate silicone based material, mush materials being known in the art. LED lighting systems and details are well known in the art and will not be discussed in detail here. An exemplary discussion relating to embeddable LED lighting systems may be found in U.S. Pat. No. 6,354,714 to Rhodes, the disclosure of which is herein incorporated by reference in its entirety.

It is further contemplated that light source assemblies of the present disclosure can also be motion activated or pulsed, responsive to movement and/or pressure applied by the use of sporting apparatus 7. That is, a circuit having a pressure and/or motion switch responsive to pressure resultant from a sport participant 2 utilizing the sporting apparatus activates a lighting circuit comprising light source assembly 8, as long as pressure is supplied and/or for a predetermined period of time or until pressure and/or motion switch is once again activated. In one embodiment, the provided circuit is controlled to operate either when a sport participant 2 causes the sporting apparatus 7 to come into contact with or removed from a contact surface, such as the ground, including ice and/or snow covered ground, or water for example. An exemplary circuit architecture/configuration for motion activation of the light source assemblies 8, is provided in U.S. Pat. No. 5,746,499, the disclosure of which is herein incorporated by reference in its entirety.

Figure 8:
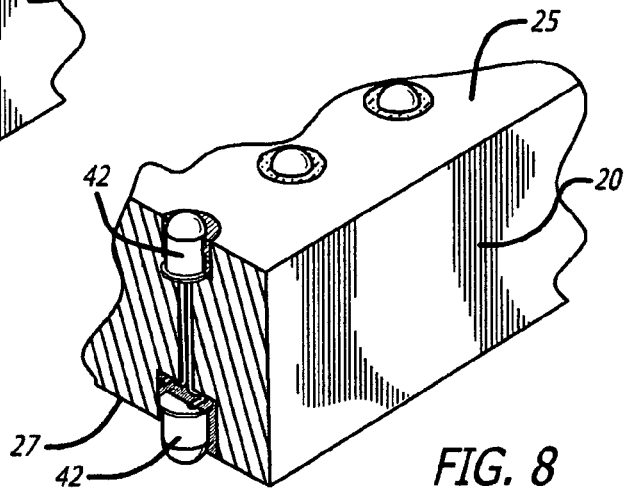
FIG. 8 depicts an exemplary light source assembly configuration in accordance with one aspect of the present disclosure.

Turning to FIG. 8, another exemplary embodiment is provided, here having a plurality of light source assemblies 8 embedded therein, here substantially flat in reference to top surface portion 25 and bottom surface portion 27.

Figure 9:
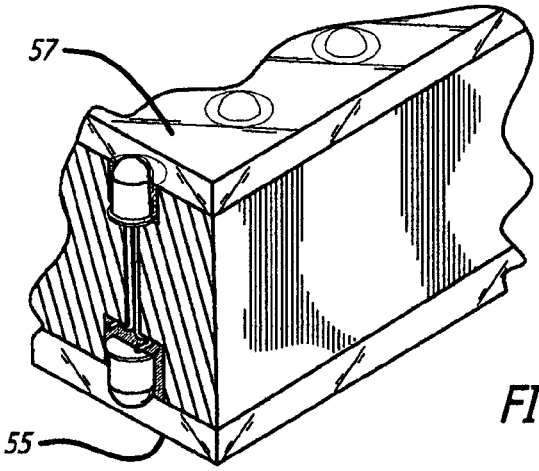
FIG. 9 illustrates an exemplary configuration of a light source assembly including a covering element.

Turning to FIG. 9, an embodiment is shown that incorporates at least one cover element. Cover element may be a top cover element 57 and/or a bottom cover element 55. One, the other or both of the cover elements, if so provided, may be clear and/or opaque and/or colored, or any combination thereof. Providing such cover elements protects light source assembly 8 from moisture and/or damage. Cover element may be provided as a strip that covers a strip of light source assemblies 8 and/or ribbon-type assembly of lights 70, and/or cover element may be provided individually for each light source assemblies 8 and not as a continuous strip/sheet covering a multiple of light source assemblies 8. Cover element may be comprised of a clear or colored polymer/plastic material or more preferably a pliable, resilient rubber or plastic material.

Figure 10:
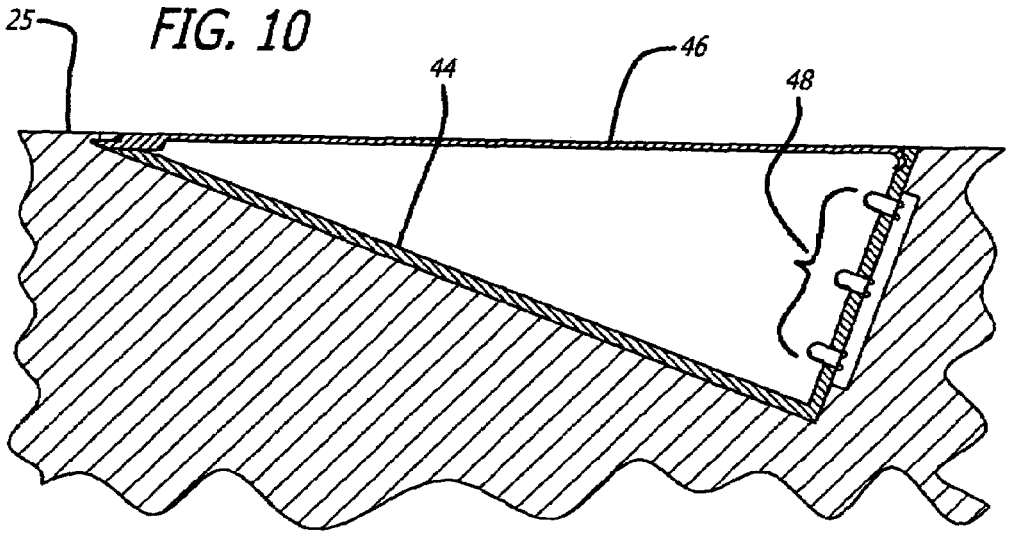
FIG. 10 is a sectional view of an exemplary arrangement of light source assemblies and reflective elements.

FIG. 10 is a sectional view of sporting apparatus having an embedded array 48 of light source assemblies 8. A subsurface reflective surface 44 provided by, for example, but not limited to, a paint, foil, or metal, is provided in substantial opposition to the embedded array 48, such that at least a portion of light emitted by the embedded array 48 is reflected upward and outwardly. While FIG. 10 depicts this configuration relative to top surface 25, the configuration may additionally or solely be provided such that light provided therefrom is radiated post bottom surface 27 or edge surface 18/20 or any combination of these. Protective overlay 46 is comprised of a clear and or substantially clear material, such as a plastic or polymer. Protective overlay can also be colored and/or opaque, as desired.

Figure 11:
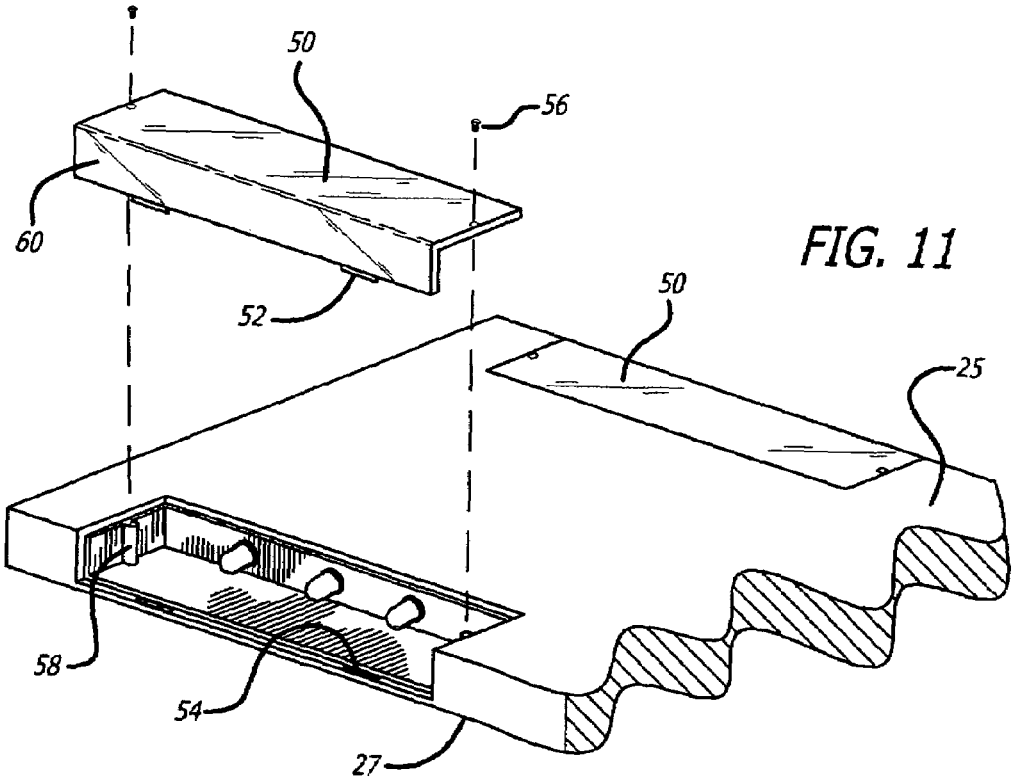
FIG. 11 depicts another exemplary configuration of a light source assembly.

FIG. 11 depicts yet another embodiment; wherein a configuration is provided such that light radiated from at least one light source assembly 8 is radiated through/past at least two surfaces of said sporting apparatus and/or planes substantially defined by at least two surfaces. Here, sporting apparatus is configured to provide a cut-out portion having at least one light source assembly 8 embedded substantially in a plane parallel to at least one of top surface 25 and bottom surface 27. An insert is provided that is secured to sporting apparatus 7 to protect and cover the cut-out portion having the at least one light source assembly 8 embedded therein. Insert has a first cover portion 50 that is fitted to be substantially even with top surface 25 of sporting apparatus 7. Insert also has a second cover portion 60 that is provided and configured to be substantially even with another plane defined by at least one of a top surface 25, bottom surface 27 and edge 18, 20. In FIG. 11, second cover portion 60 is provided to be substantially even with edge 20. Insert may be provided with securing means, for example screw 56, which passes through an appropriately provided hole in insert, and into a screw receiving portion 58, and tab 52, which will fit into corresponding slot portion 54.

Lights and/or light source assemblies are provided to conform/substantially conform to the original shape/surface of the snowboard such that there is no additional contribution to aerodynamic or frictional drag. In one embodiment, a snowboard is provided with a substantially continuous edge and/or surface in which appropriate orifices, apertures or indentations have been provided in which a lens, or transparent or translucent pane, may be placed, behind which is at least one light source assembly having at least a light is provided. Several such light source assemblies may be mounted on a single snowboard, the light source itself being recessed within the snowboard such that substantially all of the light is projected in an outwardly direction. In embodiments where the light source assembly is flush and/or recessed, particular advantages include a surface that is much easier to clean and ride on snow. Of course, where light is to be projected from the bottom of the snowboard, a smooth bottom surface is preferably maintained so as to not interfere with the board's progression through snow, such that flush and/or substantially flushed and/or recessed mounting is utilized. When recessed on any desired surface of the snowboard, the light emitting assemblies and elements, e.g. a LED and/or a bulb or any combination thereof, are less vulnerable to breakage/damage. By appropriately providing an interior portion of the recessed and embedded light source assembly, as known in the lighting arts and flashlight manufacturing, for example, with a suitable reflective material/surface, more efficient light transmission is promoted.

Furthermore, the lighting systems and associated assemblies and circuitry/layouts provided and described herein can be an arranged to produce any desired illuminating configuration or indicia, such as an arrow, numeric character, or lines and the like.

All references/documents/patents/websites cited are herein expressly incorporated by reference in their entirety. The above description provides exemplary embodiments, particularly winter sporting apparatus. It will be apparent that many modifications and variations could be achieved by one skilled in the art without departing from the spirit or scope of the novel and useful concepts disclosed in accordance with the teachings of the present disclosure, including the following claims, which can be combined and varied in any useful manner by one of ordinary skill in the art upon reading the provided disclosure. The descriptions and teachings are provided accordingly, and do not limit the present disclosure or invention in any sense to any disclosed aspect or configuration.

The invention claimed is:

1. A sporting apparatus comprising:

at least one elongated member, wherein said at least one elongated member is a snowboard having surface areas including a top, bottom and edge surfaces said edge surfaces having metal that runs either along the side of or wraps all the way around said snowboard; and at least one light source assembly having a light source embedded in at least one said surfaces of said sporting apparatus wherein a subsurface reflective surface is provided in substantial opposition to said at least one light source assembly.

2. The sporting apparatus of claim 1, wherein said light source assembly is embedded in said at least elongated member such that said light source assembly is substantially flush with an area of said at least one elongated member.

3. The sporting apparatus of claim 2, wherein said area is selected from the group consisting of top, bottom side and edge areas, or any combination thereof.

4. The sporting apparatus of claim 1, wherein said light source assembly comprises a light source and associated housing, configured to be embedded in said at least elongated member such that said light source assembly is substantially flush with an area of said at least one elongated member.

5. The sporting apparatus of claim 1, wherein said light source assembly is shock-resistant.

6. The sporting apparatus of claim 1, wherein said light source assembly utilizes a light source, said light source including at least one light emitting diode or light emitting diode array, said light emitting diode or light emitting diode array being embedded to be flush with or substantially flush or recessed relative to a surface of said sporting apparatus.

7. The sporting apparatus of claim 1, wherein said light source utilizes at least one light-emitting diode.

8. The apparatus of claim 1, wherein the at least one light source assembly is embedded in said at least one elongated member such that said at least one light source assembly is encapsulated buy a resilient rubber material.

9. The apparatus of claim 8, wherein said encapsulation is accomplished and includes at least one side of said at least one elongated member.

10. The sporting apparatus of claim 1, wherein said light source assembly further comprises a least one light conducting assembly for conducting light provided by said light source.

11. The sporting apparatus of claim 10, wherein said at least one light conducting assembly comprises at least one component selected from the group consisting of reflective material, lens and fiber optic components or any combination thereof.

12. The sporting apparatus of claim 1, wherein said at least one light source assembly is in communication with a trigger that activates said at least one light source.

13. The sporting apparatus of claim 1, wherein said at least one light source assembly is comprised of at least one light strip.

14. The sporting apparatus of claim 13, wherein said at least one light strip is comprised of at least one light emitting diode and associated bus elements, said at least one light emitting diode and associated bus elements being encased in a barrier material providing protection to the at least one light emitting diode and associated bus elements from damage and moisture.

* * * * *